United States Patent [19]

Tholander

[11] Patent Number: 4,591,107

[45] Date of Patent: May 27, 1986

[54] YARN STORAGE AND FEEDING DEVICE

[75] Inventor: Lars H. G. Tholander, Huskvarna, Sweden

[73] Assignee: Aktiebolaget IRO, Ulricehamn, Sweden

[21] Appl. No.: 711,920

[22] PCT Filed: Jul. 11, 1984

[86] PCT No.: PCT/EP84/00211

§ 371 Date: Mar. 12, 1985

§ 102(e) Date: Mar. 12, 1985

[87] PCT Pub. No.: WO85/00351

PCT Pub. Date: Jan. 31, 1985

[30] Foreign Application Priority Data

Jul. 12, 1983 [DE] Fed. Rep. of Germany ..... 3325159

[51] Int. Cl.[4] ..... B65H 51/24

[52] U.S. Cl. ..... 242/47.01; 242/47.02; 242/47.05

[58] Field of Search ..... 242/47.01, 47.02, 47.04, 242/47.05, 47.06, 47.07, 47.12, 47.13; 66/132 R, 132 T; 139/452

[56] References Cited

U.S. PATENT DOCUMENTS

| | | | |
|---|---|---|---|
| 2,091,285 | 8/1937 | Knebusch | 242/47.05 |
| 2,289,390 | 7/1942 | Torrence et al. | 242/47.05 |
| 2,386,249 | 10/1945 | McDermott | 242/47.02 X |
| 2,461,575 | 2/1949 | Stanley | 242/47.02 |
| 2,579,548 | 12/1951 | Castellan | 242/47.02 X |
| 2,656,584 | 10/1953 | Nelson | 242/47.02 X |
| 3,709,444 | 1/1973 | Tannert | 242/47.04 |
| 3,776,480 | 12/1973 | Lawson | 242/47.12 X |
| 3,796,386 | 3/1974 | Tannert | 242/47.05 X |
| 3,971,522 | 7/1976 | Pfarrwaller | 242/47.05 X |

FOREIGN PATENT DOCUMENTS 0049896 4/1982 European Pat. Off. .

*Primary Examiner*—Stanley N. Gilreath

*Attorney, Agent, or Firm*—Flynn, Thiel, Boutell & Tanis

[57] ABSTRACT

A thread storage and delivery device, with a drum-like storage body, of which the peripheral surface provides a storage surface for a thread stock and presents inside at least one cavity of which the access is ensured from the outside by at least one opening. In known devices of this type, dust and plush penetrate through the opening into the cavity and are a danger for the operation of the device, for example for the roller bearings. The shaping of the storage body as a crucible with a closed periphery and a closing lid laid from the outside is known. This configuration is technically expensive both from the construction and assembly points of view. This principle is further unapplicable when the storage body is formed of a plurality of parts which are movable with respect to each other and meshed into each other. According to the present invention, the entering of dust is readily prevented by using a filling body inserted into the cavity of the storage body and of which the upper surface closes from inside the opening to the cavity.

11 Claims, 5 Drawing Figures

29
30
27
28
40
19
26
25
1
9
13
12
14
18
23
16
15
24
S
39
10
23
17
34
36
37
22
33
32
35
20
21
11
31
38
6
4
7
2
6
5
3
8

YARN STORAGE AND FEEDING DEVICE

DESCRIPTION

1. Field of the Invention

This invention relates to a yarn storage and feeding device of the type comprising a drum-shaped storage body the circumference of which constitutes a storage surface for a yarn supply and which is provided with at least one interior hollow space to which at least one opening opens from the exterior.

2. Background of the Invention

Known from EPA No. 00 49 896 is a device of this type, wherein the storage body is formed as a double-walled cup-shaped moulding having its lengthwise end covered by an annular disk. This design prevents the intrusion of contaminants into the interior of the storage body, but manufacture of the moulding is rather complicated and expensive. Moreover, this principle cannot be applied in the case of yarn storage and feeding devices the storage body of which consists of a plurality of movably interengaging members, as in this case proper functioning of the device requires the presence of passages of or openings which permit dust and other contaminants to enter the storage body interior. This has up to now been accepted as unavoidable. In operation, however, this results in the permanent danger of failure. This danger can only be diminished by providing relatively short maintenance or cleaning intervals. This is because dust and other contaminants may enter delicate bearing assemblies or may interfere with the proper operation of feeler elements. Accumulations of such contaminants may even come to collision with the yarn supply.

It is an object of the invention to provide a yarn storage and feeding device of the type set forth above, including simple and inexpensive means which may even be installed in already existent equipment for preventing dust and other contaminants from entering the storage body and accumulating therein.

This object is attained according to the invention by inserting a filler body into the hollow interior of the storage body for closing off the openings.

The filler body fills those portions of the storage body's hollow space that are susceptible to the accumulation of dust and other contaminants. Dust and contaminants are prevented right from the start from entering the hollow space in the storage body. Dust and contaminants are of course also present, they are continuously and automatically removed, without being able to cause malfunctions. The filler body may be manufactured to any suitable shape by economical means and methods for installation in the hollow space of the storage body, with the particular advantage that the storage body of an already existent yarn storage and feeding device may be equipped with a filler body at any subsequent time. The filler body offers the particular advantage that it permits the employ of the constructional features of conventional storage bodies which disregard the contamination dangers, but which may rather be designed, as is frequently the case, as a rod- or rib cage the configuration-in-space of which has been found particularly suitable for temporarily storing yarns of widely varying properties. The filler body may also be employed for storage bodies formed of movably interengaged parts which during operation of the device continuously move relative to each other, as the filler body does not hinder these relative movements, while easily following these movements. A storage body of this type usually consists of two cup-shaped rod cages having their open ends engaged within one another, the outer surface portions of the rods of one of said cages forming a carrying surface for the yarn supply, while the outer surface portions of the rods of the other cage impart a feed movement to the yarn supply or yarn windings due to a certain tumbling or circulating movement of this cage. In addition, the storage body often has to be kept standing still relative to a moving yarn feeder element, which is accomplished by retaining one of the two rod cages, so that the other cage is also prevented from rotating due to the interengagement of the rods of the two cages. This construction necessitates the provision in the storage body of passages, the size and shape of which continuously varies and which would permit dust and other contaminants to freely enter the storage body. This permits the maintenance and cleaning intervals to be considerably extended, with the resulting economical advantages.

As the filler body has to adapt itself to the frequently rather irregular shape of the interior of the storage body and should also be capable of being manufactured and installed in a simple and economical manner, it has been found advantageous to make the filler body resilient. The resilient filler body follows the relative movements between the parts of the storage body without loosing its protective security-function. It is easy to exchange. Due to its elasticity it can be inserted with a pre-compression and it can have a desirable damping-property between the storage body parts moving relative to each other. A suitable embodiment is where the filler is only positioned where it is needed for keeping-off contaminants and e.g. for a damping effect, while it does not disturb or collide with other moving parts in the hollow space.

For a further embodiment with openings in the circumference of the storage body, the filler body safely closes the openings from the interior side but its surface does not come into contact with the yarn supply. It has, due to its possible deformations into the openings, a self-cleaning effect, i.e., the contaminants continouosly and automatically are carried away.

A further advantage is the embodiment of forming the filler body of a foamed material. Plastics foam is easily processed, readily adapts itself to practically any shape, and can be moulded to practically any configuration. In addition, plastics foam is durable, lends itself to immunization against electro-static charge accumulation and is fatigue- and wear resistant even in the case of variable loads. An advantageous embodiment is where the filler body has a smooth and non-permeable skin. The skin does not reduce the resiliency of the filler body if the latter is installed in a storage body formed of relatively movable elements. Quite to the contrary, the skin substantially eliminates otherwise possible fatigue or wear of the filler body. Moreover, dust and contaminants do not adhere to the smooth an non-permeable skin of the filler body, so that they are continually and automatically carried away.

A further suitable embodiment employs a filler body formed as a hollow resilient body filled with a gaseous medium or a resilient fiber material. The resiliency of the hollow body and its filling permits the filler body to closely conform even to inticrate shapes of the storage body interior. The resilient filler material employed is not restricted to gaseous media but may include any inexpensive material such as plastics foam residues, lint, fibres, granular or powdery materials, loosely packed polystyrol pellets or the like.

A particularly simple and advantageous embodiment employs a filler body formed as an inflated toroidal hose formed of plastics or rubber. Even in the case of an integrally formed or permanently assembled storage body, a hose of the type described could be introduced thereinto through one of the openings or passages and subsequently inflated to conform to the shape of the interior.

A further advantageous embodiment is where the storage body is formed of two cup-shaped rod cages interengaged with each other at their open ends. The filler body may be provided in the form of a moulding conforming to the interior so as to completely fill it, possibly with some pre-compression.

Of importance, the filler body, e.g., a polyurethane-form element, produces a desirable damping which prevents a direct mutual contact and undue wear between the parts of the storage body moving relative to each other. In a simple manner said toothing can be achieved by grooves in the filler body and by ribs on the interior sides of the cage rods, said ribs engaging into the grooves.

BRIEF DESCRIPTION OF THE DRAWINGS

Embodiments of the invention shall now be described in detail with reference to the accompanying drawings, wherein.

DETAILED DESCRIPTION

Figure 1:
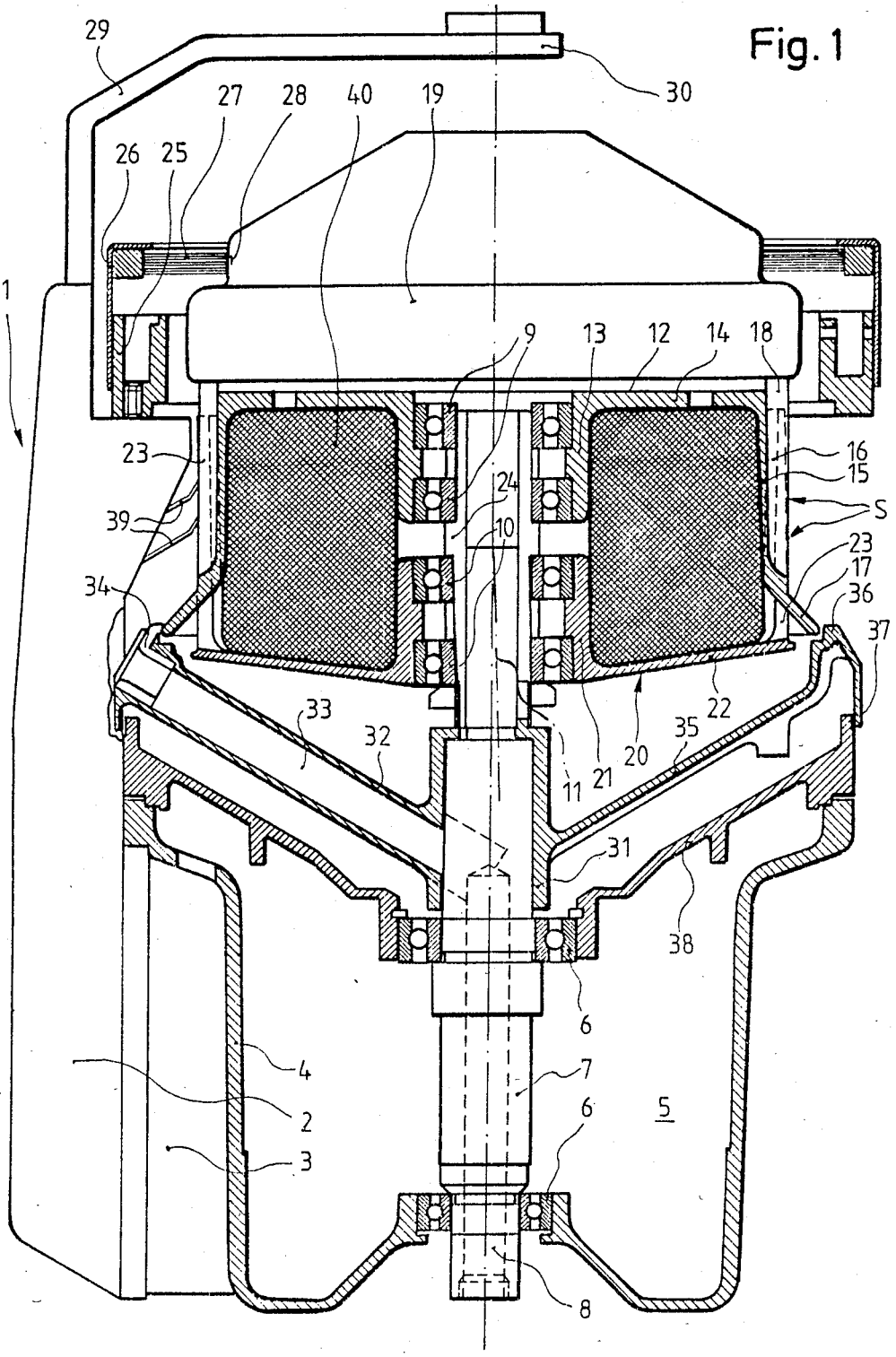
FIG. 1 shows a longitudinal sectional view of a yarn storage and feeding device.
Figure 2:
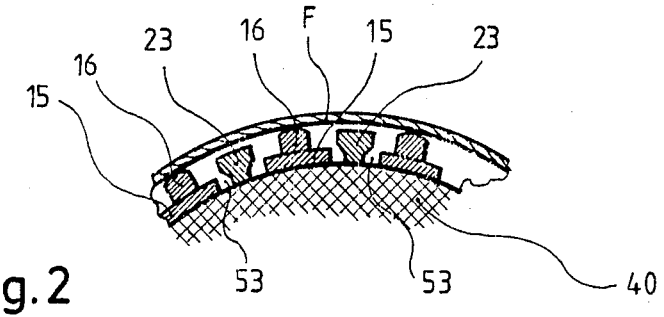
FIG. 2 shows a cross-sectional view of a portion of the storage body of the device shown in FIG. 1.

A yarn storage and feeding device 1 as shown in FIGS. 1 and 2 comprises a carrier member 2 attached at 3 to a mounting structure (not shown) of a textile machine and carrying a cup-shaped housing 4 for installation therein of a drive motor 5 not shown in detail. Housing 4 is closed by a cover 38 of conical configuration. Bearings 6 carry a rotatable drive shaft 7 for device 1 adapted to be driven by motor 5. The portion of shaft 7 projecting from the housing 4 is formed with a longitudinal channel 8 and the purpose of which will be explained as the description proceeds.

Rotatably mounted on the other end of shaft 7 by means of pairs of bearings 9 and 10, respectively, is a pair of cup-shaped rod cages 12 and 20 engaging each other with their open ends. The rotary axis of bearing pair 10 and thus of rod cage 20 is designated by reference numeral 11. This axis is inclined with respect to the axis of shaft 7. The mounting of rod cage 12 on bearing pair 9 is accomplished by means of a hub member 13 from which a cage bottom 14 extends substantially radially outwards. Coaxially with and substantially concentric to hub member 13 rod cage 12 is provided with a circumferential wall 15 formed with longitudinally extending rods 16. Towards the open end of rod cage 12, rods 16 terminate in a conically diverging flange 17, while their opposite ends 18 project into a hat-type cover 19, thereby connnecting it to rod cage 12. The peripheral portions of circumferential wall 15 extending between rods 16 are formed with openings 53 as shown in FIG. 2.

Rod cage 20 is also formed with a hub portion 21 by means of which it is mounted on bearing pair 10. A slightly conical cage bottom 22 extending outwards and slightly upwards from hub portion 21 has its outer peripheral portion formed with longitudinal rods 23 extending coaxial with rotary axis 11 into openings 53 of rod cage 12 to points closely adjacent the level of cage bottom 14. Surface portions of rods 16 and 23, respectively, form the active storage surface S of the storage body comprised of the two rod cages 12 and 20 and hat-type cover 19. Bearing pairs 9 and 10 are mounted on shaft 7 by the intermediate of a sleeve 24 which determines the inclination of axis 11.

Rigidly attached to carrier member 2 substantially at the level of the rim of hat-type cover 19 is an annular member 25 adapted to have affixed to the inside thereof at least one magnet (not shown) in alignment with a magnet located within hat-type cover member 19. The cooperation of these magnets with one another is effective to prevent cover member 19 and thus rod cage 12 from rotating on shaft 7. The engagement of rods 23 with openings 53 is similarly effective to prevent rod cage 20 from rotating on shaft 7.

Annular member 25 further carries a support 26 containing a conventional yarn brake 27 contacting for instance a yarn payout rim 28 of cover member 19. Also affixed to carrier member 2 is a carrier arm 29 carrying a yarn payout guide eyelet 30 in longitudinal alignment with the rotary axis of shaft 7.

The portion of shaft 7 containing the inner end of longitudinal channel 8 carries a non-rotatable sleeve 31 formed with a yarn feed guide element 32 in the shape of a tube having a longitudinal channel 33 and extending radially outwards and at an inclined angle towards the storage body. Longitudinal channel 33 communicates with longitudinal channel 8 of shaft 7. The outer end of yarn guide member 32 carries a yarn eyelet 34 the outlet opening of which is located just outwards of the edge of flange 17 of rod cage 12. Yarn guide element 32 is formed as an integral part of a conical shield 35 integrally connected to sleeve 31. The outer rim 36 of shield 35 cooperates with the edge of flange 17 to form a labyrinth seal. A depending apron 37 of shield 35 surrounds the outer edge of cover 38, so that a similar seal is formed at this location. The two thus formed seals substantially protect the adjacent interior portions of the device against the intrusion of dust and any contaminating material released by the yarn.

Also provided on carrier member 2 are feeler elements 39 cooperating with the storage surface S of the storage body as by extending into the spaces between rods 16 and 23.

FIG. 2 shows a portion of a yarn winding F supported on the outer surfaces of rods 16. To this effect, the yarn is guided through longitudinal channels 8 and 33 and yarn guide eyelet 34 so as to be tangentially wound onto storage surface S. In this manner, a plurality of yarn windings are formed to provide a yarn supply from which the yarn is then withdrawn through a gap between yarn brake 27 and payout rim 28 and on through yarn guide eyelet 30 in axial direction.

The device operates as follows: As soon as the yarn has been threaded through the device in the above described manner and the remainder of the apparatus is ready for operation, the feeler elements 39 determine the magnitude of the yarn supply. If the yarn supply is less than a predetermined axial magnitude, feeler elements 39 generate a signal for starting motor 5. Rotation of shaft 7 thereupon causes yarn guide element 32 to wind further yarn windings onto storage surface S until the yarn supply has again reached a predetermined magnitude. Independently thereof, yarn of the required length is withdrawn from the yarn supply via yarn guide eyelet 30. Rod cages 12 and 20 are prevented from rotating in unison with shaft 7 by magnetic attraction forces. The inclination of rotary axis 11 causes rod cage 20 to perform a tumbling movement relative to rod cage 12, whereby its rod 23 temporarily project beyond the outer surfaces of rods 16 so as to impart a feeding movement to the yarn supply. This is particularly shown in FIG. 1, at the lefthand side of which the contours of rods 23 extends outward of the contour of rods 16, while at the right-hand side the contour of rods 23 (shown in dotted lines) is recessed inwards of the contour of rods 16. FIG. 2 shows rods 23 partially retracted into the openings 53 just clear of yarn windings F.

This function principle is per se known.

The interior hollow space of the storage body is completely filled by a filler body 40 formed for instance of a resilient plastics foam and retained under slight precompression. Filler body 40 has been inserted prior to force-fitting rod cages 12 and 20 onto sleeve 24. As shown in FIG. 2, filler body 40 closely engages the interior wall surface of circumferential wall 15 of rod cage 12 as well as the interior faces of rods 23. The resiliency of filler body 40 permits it to adapt itself to the relative movements of these parts without the possibility of dust or contaminants entering the storage body through openings 53 or from above or below around the edge of the cage bottom 22.

In FIG. 1 cage bottoms 14 and 22 are shown as being continuous. Inasmuch, however, as filler body 40 provides effective protection also in these areas, cage bottoms 14 and 22 may also be formed by a number of spokes, each of which is preferably bent off to provide one each of the longitudinally extending rods. This construction may be advantageous for reasons of weight-saving and/or facility of manufacture.

Figure 5:
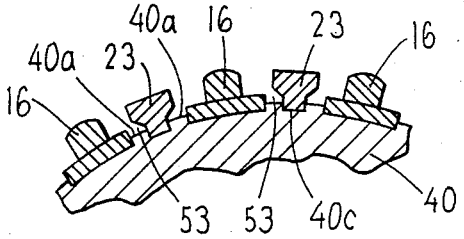
FIG. 5 shows a cross-sectional view corresponding to the one shown in FIG. 2, but of a still further embodiment.

In FIG. 2, the cage rods 16,23 have a cross-section which keeps the openings into the hollow space very slim. The danger of a direct initial contact between the cage rods can be eliminated by the filler body 40 inserted with a pre-compression and acts in a damping manner. It could even have a toothing with the cage rods to prevent their mutual contact. Such toothing is illustrated at 40*a* in FIG. 5.

Figure 3:
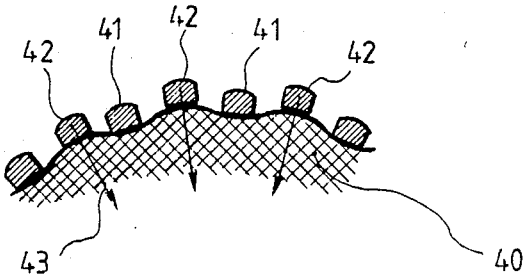
FIG. 3 shows a cross-sectional view corresponding to the one shown in FIG. 2, but of another embodiment.

FIG. 3 shows a cross-sectional view of a further embodiment wherein rods 41 and 42 of two rod cages are movable relative to each other in the manner described above. Openings formed between rods 41 and 42 are of relatively great size in the circumferential direction. In the condition shown, rods 42 are moving inwards in the direction of arrows 43. The interior surfaces of rods 41 and 42 are again engaged by the filler body 40 the precompression of which is selected such that its surface bulges outwards in the area of the openings without projecting as far as the storage surface, so that it is prevented from colliding with the yarn windings on the storage surface.

It is possible to give the surface of the filler a performed profile as shown, in order to have a certain interengagement between the filler body 40 and the cage rods 41,42 which leads to a damping effect between the cage rods which move relative to each other.

Figure 4:
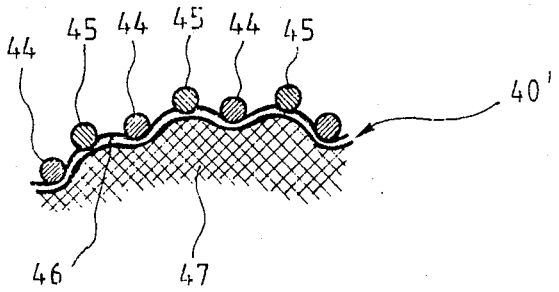
FIG. 4 shows a cross-sectional view corresponding to the one shown in FIG. 2, but of still another embodiment

A further embodiment is shown in FIG. 4, wherein the relatively movable rod cages are formed of rods 44 and 45 of circular cross-section at rather wide circumferential spacings. In this case, filler body 40 is formed as a hollow body 46 filled with a resilient filler material 47 or with a gaseous medium, permitting it to adapt itself to the movements of rods 44 and 45 relative to each other and to project over a considerable distance into the openings without colliding with the yarn windings on the storage surface.

The filler body indicated in FIG. 3 may also consist of individual foamed plastics flakes or shreds having a greater size than the openings. These foamed plastics flakes may then be compressively stuffed into the storage body so as to completely fill it, thus preventing the intrusion thereinto of dust and other contaminants. In the case of permanently assembled storage bodies of cage-like construction it is also possible to introduce a resilient balloon envelope thereinto and to subsequently inflate it so as to completely fill the hollow space of the storage body. It is further contemplated to introduce a resilient envelope into the storage body and to subsequently inject a foam material thereinto, so that the envelope adopts the shape of the storage body hollow space to completely fill it.

In the case of a moulding of a foamed material it is preferred to provide it with a smooth and non-permeable outer skin so as to prevent dust and other contaminants from adhering thereto. The skin may already be formed during the foaming or expansion of the moulding (in situ foaming). The visible portions of the filler body surface closing the openings may also be provided with a reflecting, layer, a luminous layer or a light-absorbing layer. This would be particularly advantageous in the case of employ of optical sensing means 39, as it would enable them to reliably detect the yarn supply by a strong contrast effect.

I claim:

1. In a yarn storage and feeding device having a drum-shaped storage body the circumference of which constitutes a storage surface for a yarn storage, said storage body including two groups of cage rods, the cage rods of one group being movable in relation to the cage rods of the other group, said cage rods of both groups being arranged in an alternating manner and defining openings therebetween into at least one hollow interior space of the storage body, a resilient body being provided within said interior hollow space, comprising the improvement wherein said resilient body is a closed filler body filling the hollow interior space, said filler body simultaneously abutting the inner surfaces of the cage rods of both groups with radial preload and closing all said openings from the inner side thereof independently of the relative movement between the cage rods and the initial relative position of the cage rods to each other.

2. A yarn storage and feeding device according to claim 1, wherein the filler body is made of resilient material.

3. A yarn storage and feeding device according to claim 2, wherein said filler body consists of a synthetic foam material.

4. A yarn storage and feeding device according to claim 1, wherein said filler body is covered with a smooth and no-permeable skin.

5. A yarn storage and feeding device according to claim 1, wherein said filler body is a resilient and closed hollow body filled with a gaseous medium or with a resilient filler material.

6. A yarn storage and feeding device according to claim 1, wherein said filler body is an inflated toroidal hose formed of plastics or rubber.

7. A yarn storage and feeding device according to claim 1, wherein said storage body consists of two cup-shaped rod cages which are put together with their open ends so that always one rod of one cage engages between two rods of the other cage, and wherein said filler body is a plastics, rubber or foam material molded part inserted between said rod cages with a radial preload.

8. A yarn storage and feeding device according to claim 7, wherein said rod cages are rotatably mounted on a shaft with hub members adjacent their cage bottoms, and wherein said filler body is of annular shape having its outer periphery, its end faces and its inner periphery sealingly contacting the inner surfaces of said cage rods, the bottoms of said rod cages and said hub members, respectively.

9. A yarn storage and feeding device according to claim 1, wherein the outer periphery of said filler body comprises a reflective layer, a luminous layer or a light-repellent layer.

10. A yarn storage and feeding device according to claim 1, wherein in the circumferential direction of the storage surface a toothing is provided between the surface of the filler body and the rods of the rod cages.

11. In a yarn storage and feeding device having a drum-shaped storage body defining a circumferential storage surface for yarn storage, said storage body including first and second groups of rods respectively defining first and second cages, the rods of the first cage being movable relative to the rods of the second cage, and the rods of the first and second cages being arranged circumferentially in an alternating manner so as to define openings between adjacent said rods which open inwardly into a hollow interior space defined within the storage body, the improvement comprising a closed resilient body filling the hollow interior space of said storage body, said resilient body having the periphery thereof maintained in continuous abutting contact with inner surfaces of the rods of both the first and second cages, said closed resilient body maintaining its peripheral surface radially preloaded against the inner surfaces of all of the rods of said first and second cages irrespective of the initial positions of the rods and irrespective of the relative movements therebetween, said closed resilient body closing all of said openings from the radially inner sides thereof.

* * * * *

UNITED STATES PATENT AND TRADEMARK OFFICE

CERTIFICATE OF CORRECTION

PATENT NO. : 4 591 107

DATED : May 27, 1986

INVENTOR(S) : Lars Helge Gottfrid Tholander

It is certified that error appears in the above-identified patent and that said Letters Patent is hereby corrected as shown below:

Column 7, line 3; change "no-permeable skin" to ---non-permeable skin---.

Signed and Sealed this

Twentieth Day of January, 1987

*Attest:*

DONALD J. QUIGG

*Attesting Officer*

*Commissioner of Patents and Trademarks*